United States Patent [19]

Kimm et al.

[11] 4,276,988

[45] Jul. 7, 1981

[54] TAMPER-PROOF CLOSURE

[75] Inventors: Otfried Kimm; Theo Hammes; Peter Loebler, all of Cologne, Fed. Rep. of Germany

[73] Assignee: Mauser-Werke GmbH, Brühl, Fed. Rep. of Germany

[21] Appl. No.: 113,274

[22] Filed: Jan. 18, 1980

[30] Foreign Application Priority Data

Jan. 19, 1979 [DE] Fed. Rep. of Germany ..... 2901953

[51] Int. Cl.[3] ..... B65D 41/62; B65D 55/06

[52] U.S. Cl. ..... 215/254; 215/253; 220/214; 220/266; 220/270; 292/307 B

[58] Field of Search ..... 220/214, 270, 266; 215/251, 252, 253, 254; 292/307 B

[56] References Cited

U.S. PATENT DOCUMENTS 2,021,084 11/1935 Nutter ..... 215/251

3,860,148 1/1975 Sherin ..... 220/266 X

FOREIGN PATENT DOCUMENTS 2548132 5/1977 Fed. Rep. of Germany ..... 220/214

*Primary Examiner*—Donald F. Norton

[57] ABSTRACT

A tamper-proof closure includes a seal cap and a lock ring for securement to a container having a screw cap. The lock ring has a first portion integrally formed with the bottom of portion of the seal cap and a second portion which is breakably detachable from the seal cap. The second portion of the lock ring is secured to the seal cap by spaced severable attachments. The first and second portions are separated by recesses one of which receives a projection on the container. The seal cap is secured over the screw cap by lips which are formed at its bottom edge and which catch the bottom edge of the screw cap.

11 Claims, 4 Drawing Figures

TAMPER-PROOF CLOSURE

TECHNICAL FIELD OF THE INVENTION

The present invention relates to closures for containers. In particular, the present invention is directed to tamper-proof closures consisting of a screw cap and a plastic lock ring which can be destroyed during the first unscrewing. More particularly, the screw cap and lock ring are separate units.

BACKGROUND ART

Lock rings are provided on tamper-proof closures so as to provide externally visible evidence of an unauthorized opening of a screw cap for the removal of the contents of a container. For this purpose, identations, which break open all at the same time when the cap is unscrewed, are uniformly distributed over the circumference of the lock ring. However, as a result of the simultaneous breaking open of several indentations distributed over the lock ring, enough clearance is formed so that the lock ring can be stretched sufficiently without actually severing the individual parts of the ring. The integrity of the lock ring is preserved, so that the ring parts which are still attached together can be squeezed together again after reclosure. Thus, any reliable indication of an unauthorized opening of the container is largely defeated.

In an attempt to overcome such problems, Offenlegungsschrift 2,607,991 discloses a tamper-proof closure created such that the complete severance of only one ring part definitely occurs when the screw cap is unscrewed. Therefore, no possibility exists of imitating an original closure by squeezing together the ring portions which have been broken open.

Since only one snap-off section is provided and the remainder of the ring remains closed, the bursting force is concentrated in only two indentations. There is no other way for the ring to yield. Since the opening of the indentations takes place successively, the break-away section is removed from the ring and is discarded as a whole. Thus, it is no longer possible to put the separate parts of the ring back together again.

However, a disadvantage results from the complicated construction of the very shallow lock ring which, in the rough container filling operation, can be unintentionally broken if it is not carefully placed on the neck of the container prior to screwing the screw cap on. Even when the ring is simply grasped by gloved and therefore comparatively insensitive hands of the operator, breakage of the ring is always possible. Furthermore, the lock ring is placed in the locked position when the screw cap is turned. The lock ring is held against rotation by separate tongues which yield in the tightening direction but hold fast in the unscrewing direction by engaging stop projections. The delicate tongues are broken off if the screw cap is tightened and the position of the ring is not precisely adjusted.

Applicants have invented a tamper-proof closure which overcomes the above-noted limitations of the prior art.

DISCLOSURE OF INVENTION

The present invention is directed to a tamper-proof closure for containers having a screw cap. The closure includes a seal cap and a lock ring separate from the screw cap. The lock ring is formed on the bottom portion of the outer circumference of the seal cap. The lock ring has a single break-away section. Also the closure and the screw cap are preferably made of plastic. By means of the present invention, a tamper-proof closure is obtained such that the lock ring is no longer transported to its effective position by the turning of the screw cap. The ring construction is thus substantially simplified and more strongly made. Also the fitting and manipulation of the ring is substantially improved.

According to the present invention, a tamper-proof closure for containers having a screw cap and a projection on the container comprises a seal cap having a dimension and configuration adapted for receiving at least a portion of the screw cap therein, and a lock ring disposed about the seal cap at one end thereof. The lock ring is characterized by a first portion integral with the seal cap and a second portion breakably attached to the seal cap. The first and second portions are separated at their respective ends by recesses. The projection is disposed within one of the recesses when the seal cap is installed on the screw cap such that when the screw cap is opened, the second portion is at least partially detached from the seal cap and thereby evidences tampering with the screw cap.

In accordance with a preferred embodiment of the present invention, the closure comprises a seal cap and a lock ring having a fixed section or portion and at least one break-away section separated therefrom by recesses which are integrally formed on the bottom part of the outer circumference of a seal cap. When the screw cap is in the screwed-on state, the seal cap is placed on the screw cap and catches on the bottom edge of the screw cap by means of lips formed on its bottom inside edge. The break-away section is joined to the outer circumference of the seal cap by severable attachments. One of the recesses between the fixed ring portion and the break-away section engages a projection provided on the container so as to resist rotation when the seal cap is in the installed state. A snap-off tab flanked by weakening indentations is disposed on the side of the seal cap opposite this recess.

Inasmuch as the lock ring now is part of the seal cap, operation is greatly facilitated. The lock ring function is now separate from that of the screw cap which is now surrounded by the seal cap.

In operation, the screw cap is installed after the container filling operation. Then the seal cap is clamped by the lock ring onto the screw cap and is held on the latter by the lips so as to be vertically immovable. At the same time, the recess on the side opposite the snap-off tab engages the projection on the container. The recess is comparatively wide so that no special effort is necessary for fitting it. To remove the seal cap, the snap-off tab is removed so as to break open the seal cap.

If a tamperer attempts to open the screw cap with pipe pliers applied to the seal cap, the break-away section strikes against the projection on the container and is torn away. This thus provides evidence of the tampering.

In a further embodiment of the present invention, the outer wall of the lock ring and of the break-away section is drawn outwardly beyond the inner catch edge of the seal cap. Thus, when the cap is in the installed state, the outer wall reaches all the way down to the wall of the canister. This prevents the insertion of a prying tool between the stationary part of the lock ring and the container wall so as to pry the seal cap upwardly from its engaged position. Moreover, vertical weakening indentations are disposed in the outer periphery of the fixed portion of the lock ring so as to provide additional security against prying off. These indentations will burst open if force is applied.

DESCRIPTION OF THE DRAWINGS

The present invention is described in detail below with reference to the drawings, wherein.

DETAILED DESCRIPTION OF THE BEST MODE

Figure 1:
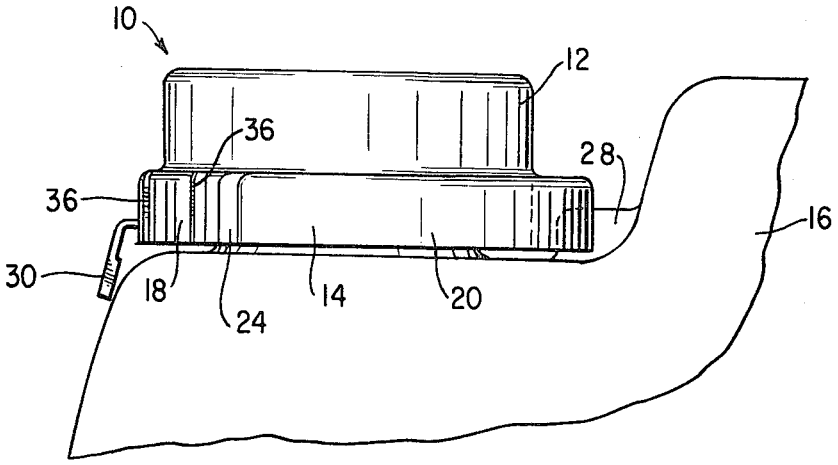
FIG. 1 is a partial side elevational plan view of a container having a tamper-proof closure according to the present invention.
Figure 2:
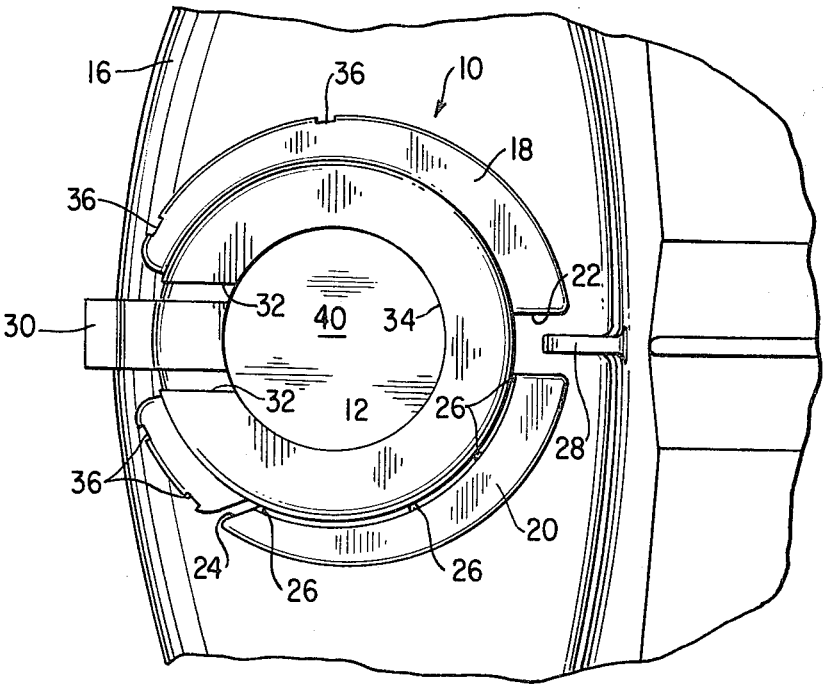
FIG. 2 is a top view of the tamper-proof closure of FIG. 1.
Figure 3:
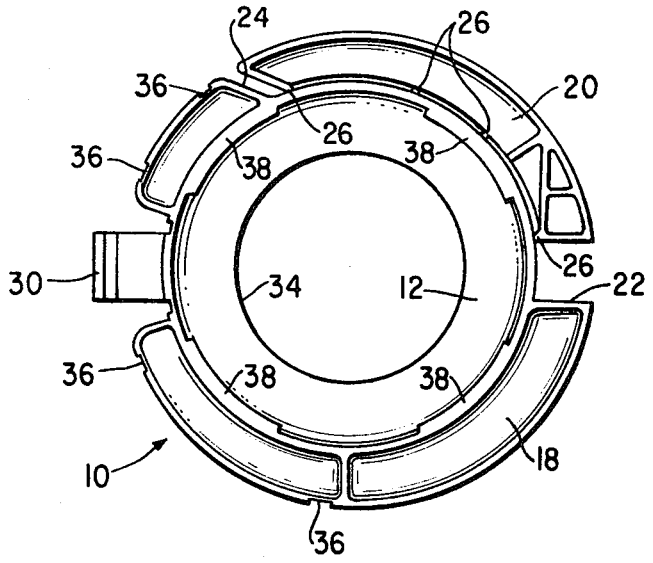
FIG. 3 is a bottom view of the tamper-proof closure of FIG. 1.

Referring to the Figures, a tamper-proof closure 10 is shown including a seal cap 12 and a safety or lock ring 14 for securement to a container 16. The lock ring 14 has a set portion 18 formed integrally with the bottom portion of the seal cap 1 and a break-away portion or section 20. The break-away section 20 is separated from the set portion 18 by recesses 22 and 24. Severable attachments 26 provided for joining to the outer periphery of the cap 12. As illustrated in FIG. 2, a projection 28 is provided on the container 16 and extends into the recess 22 when the seal cap 12 is placed on the container 16 thereby forming an obstacle to turning.

A snap-off tab 30 is disposed on the safety ring 14 opposite the recess 22 and has adjacent weakening indentations 32. The weakening indentations 32 extend to the circular opening 34 in the top surface of the seal cap 12 to facilitate severance. Furthermore, vertical weakening indentations 36 are provided in the outer periphery of the set portion 18 of the safety ring 14.

Figure 4:
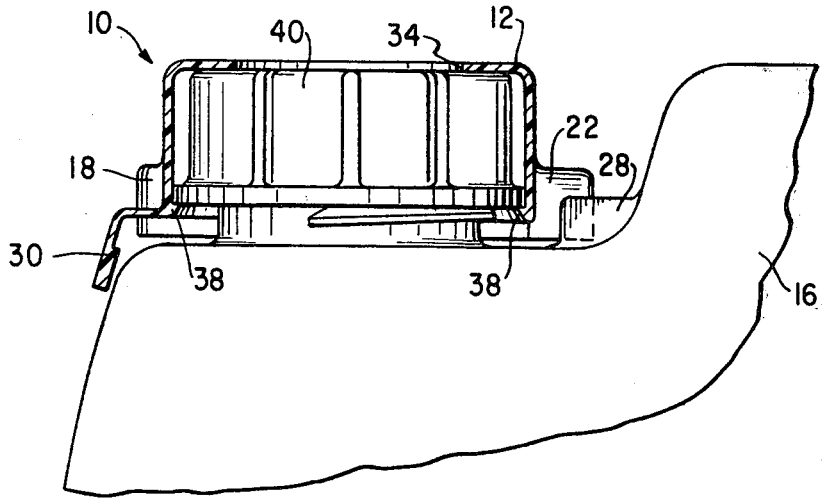
FIG. 4 is a partial cross-sectional view of the tamper-proof closure of FIG. 1 illustrating the seal cap.

As shown in FIG. 4, the seal cap 12 has lips 38 formed at its bottom edge. The lips 38 catch on the bottom edge of the screw cap 40.

The outer wall of the lock ring 14 and the break-away section 20 extend outwardly beyond the inner lip 38 of the seal cap 12. When the cap 12 is installed, they extend all the way down to the container wall.

We claim:

1. A tamper-proof closure for containers having a screw cap and a projection on the container, comprising:

a. a seal cap having a dimension and configuration adapted for receiving at least a portion of the screw cap therein;

b. a lock ring disposed about the seal cap at one end thereof, and characterized in that the lock ring has:

(1) a first portion integral with the seal cap;

(2) a second portion breakably attached to the seal cap;

the first and second portions being separated at their respective ends by recesses, the projection being disposed within one of the recesses when the seal cap is installed on the screw cap such that when the screw cap is opened, the second portion is at least partially detached from the seal cap and thereby evidences tampering with the screw cap.

2. The closure according to claim 1 wherein said second portion is attached to said seal cap by a plurality of spaced attachment members.

3. The closure according to claim 2 wherein said closure further comprises means for engaging one end of the seal cap with the bottom edge of the screw cap.

4. The closure according to claim 3 wherein the engaging means comprises a plurality of members extending radially inwardly of the seal cap.

5. The cosure according to claim 4 wherein the seal cap comprises a detachable tab disposed opposite said recess within which the projection is disposed.

6. The closure according to claim 5 further comprising at least one weakening indentation flanking the tab so as to aid in the removal of the tab and the seal cap from sealing engagement with the screw cap.

7. The closure according to claim 1 characterized in that the outer wall of the lock ring extends generally radially beyond the inner catch edge of the seal cap and, when the cap is in the installed state, reaches generally to the wall of the container.

8. The closure according to claim 7 characterized in that the top surface of the seal cap has a circular opening.

9. The closure according to claims 1, 7 or 8 characterized in that the outer periphery of the first portion of the lock ring has vertical weakening indentations disposed therein.

10. A tamper-proof closure for containers having a screw cap and a projection disposed on the container, comprising a seal cap and a lock ring having a stationary ring part and at least one break-away section, the lock ring being destroyable by improper opening, characterized in that:

(a) the stationary ring part and the break-away section are separated by recesses;

(b) the stationary ring part and the break-away section are formed integrally on the bottom portion of the outer circumference of the seal cap;

(c) the seal cap having on its bottom inside edge at least one catch member adapted for engaging the bottom edge of the screw cap and securing the seal cap thereto when the screw cap is in a screwed-on-state;

(d) the break-away section being secured to the outer circumference of the seal cap by a plurality of severable attachments, the break-away section being capable of engaging in a turn-proof manner with one of the recesses between the stationary ring part section and the break-away section, the projection on the container when the seal cap is in the installed state; and (e) a break-away tab flanked by weakening indentations is disposed on the side of the seal cap opposite the one recess.

11. The closure according to claim 10 wherein the lock ring is constructed of plastic.

* * * * *